United States Patent [19]

Hopley

[11] 4,345,690

[45] Aug. 24, 1982

[54] SAFETY CLOSURE

[75] Inventor: Eric T. Hopley, Norwich, England

[73] Assignee: U.G. Closures & Plastics Limited, Middlesex, England

[21] Appl. No.: 942,805

[22] Filed: Sep. 15, 1978

[30] Foreign Application Priority Data

Sep. 19, 1977 [GB] United Kingdom ..... 38896/77

[51] Int. Cl.[3] ..... B65D 55/02; B65D 85/56; A61J 1/00

[52] U.S. Cl. ..... 215/216; 215/221

[58] Field of Search ..... 215/216, 221, 730

[56] References Cited

U.S. PATENT DOCUMENTS 3,993,209 11/1976 Julian ..... 215/216

*Primary Examiner*—George T. Hall

*Attorney, Agent, or Firm*—Cushman, Darby & Cushman

[57] ABSTRACT

There is described a container and a closure cap therefor, wherein the neck of the container is screw-threaded and is provided with at least one lug beneath the screw thread, the closure cap comprising a top, a screw-threaded depending skirt and an annular band attached to the skirt by spaced bridges, the annular band being provided with one or more fins adapted to engage the lug(s) on the container neck, the annular band being deformable by radial pressure at positions spaced from the fin(s) to increase the diameter of the band in the region of the fin(s) such that the fin(s) do not engage the lug(s) on the container neck.

5 Claims, 4 Drawing Figures

SAFETY CLOSURE

This invention relates to containers and closure caps, and is especially concerned with the provision of a child-resistant closure cap/container combination, for use with, for example, medicines and poisonous materials.

Many types of child-resistant closure caps are available and many more have been proposed. Typical amongst these is the type of cap, often a two-piece cap, which requires the application of both downward pressure and unscrewing torque for its removal. Such caps may be referred to for convenience as "press-and-turn" caps, and an example of such a cap is that described in U.S. Pat. No. 3,055,524. Another known form of child-resistant cap is that which may conveniently be referred to as a "squeeze-and-turn" cap, and which requires for opening the squeezing of the cap skirt, to deform the skirt and thus disengage coacting retaining members on the cap skirt and container neck, and the simultaneous turning of the cap in the unscrewing direction. An example of a "squeeze-and-turn" cap is that described in U.S. Pat. No. 2,827,193. It is with the "squeeze-and-turn" type of cap that the present invention is particularly concerned.

It has been found that the manufacture and use of such caps present problems. Thus, a fine balance has to be found between the necessary rigidity for the walls of the cap in order for them to function properly, and the requirement that the wall should nevertheless have a certain degree of flexibility in order that they may be deformed by finger pressure so that the cap may be removed. Most "squeeze-and-turn" caps operate on the principle of exerting finger pressure at two diametrically opposite points on the cap skirt, with the result that those parts of the skirt at 90° to the pressure-application points are forced outwardly. Clearly, for this to happen the cap skirt must not be too rigid. Again, if the skirt is too rigid there can be wear on the cooperating retaining members, e.g. lugs, on the cap with possible loss of effectiveness of the safety feature after several opening and closing operations.

It is the object of the present invention to provide a safety cap of the "squeeze-and-turn" type in which the drawbacks mentioned above in existing such caps do not have to be considered, and which is simple and inexpensive to manufacture.

According to the present invention there is provided a container and a closure cap therefor, wherein the neck of the container is screw-threaded and is provided with at least one lug beneath the screw thread, the closure cap comprising a top, a screw-threaded depending skirt and an annular band attached to the skirt by spaced bridges, the annular band being provided with one or more fins adapted to engage the lug(s) on the container neck, the annular band being deformable by radial pressure at positions spaced from the fin(s) to increase the diameter of the band in the region of the fin(s) such that the fin(s) do not engage the lug(s) on the container neck.

Both the container and the closure cap may be moulded from plastics material, or the container may be a glass or metal container. The top and skirt of the cap may be relatively rigid, but the annular band attached to the skirt must be deformable by radial pressure to the extent necessary to remove the fins from engagement with the lugs. Polyethylene, polypropylene, polystyrene and like materials are suitable for manufacturing both the container and the closure cap.

Preferably, the container neck is provided with two lugs, diametrically arranged, and the annular band of the closure cap is provided with two engaging fins, also diametrically arranged.

The annular band may be attached to the skirt of the closure cap by any suitable number of bridges, but preferably these bridges are four in number. They are also preferably spaced such that when radial pressure is applied to the annular band to deform it (from circular to elliptical in shape), the bridges are not deformed to any substantial extent. By this means the flexibility of the deformable annular band will not be influenced by the stiffness or otherwise of the skirt of the cap to which it is attached, which skirt will not be deformed when the annular band is.

The closure cap of the invention will be attached to a container neck by the usual screwing action. As the cap is screwed home, the fins on the annular band will ride over the lugs on the container neck, and for this purpose the fins are preferably formed at an angle to the radius of the band, the lugs being formed with a ramp face. Unscrewing of the cap brings the fins on the band into engagement with the lugs on the container neck, and further unscrewing is prevented. However, by applying radial pressure to the band at positions spaced from the fins and lugs, the band is deformed, the fins pass over the lugs and the cap may be unscrewed in the normal way.

The cap may be provided with flat portions or indicator arrows, to indicate where radial pressure should be applied. Where there are two fins formed on the band, pressure should be applied at right angles to them.

The accompanying drawings illustrate schematically two embodiments of the present invention. In the drawings.

Figure 1:
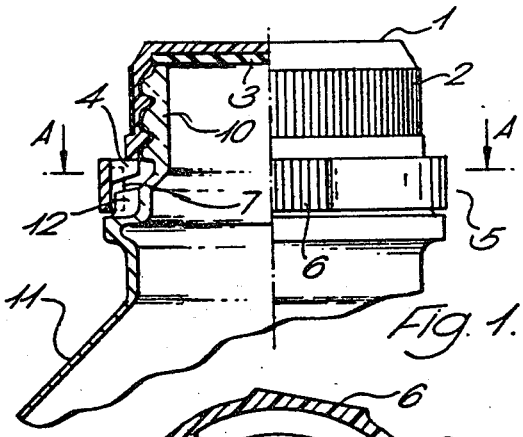
FIG. 1 is a part-sectional elevation of a closure cap attached to the neck of a container.

Referring to FIG. 1 a closure cap comprises a top 1 and a depending skirt 2 which is internally screw-threaded. The inside of the cap is provided with a sealing liner 3. Attached to the lower end of skirt 2, by four spaced bridges 4, is an annular band 5. The external surface of band 5 is provided with two flat portions 6, and two diametrically-opposed inclined fins 7 are moulded integrally with the inside surface of the band.

The cap is screw-threadedly attached to the neck 10 of a container 11. Provided on the container neck beneath the screw-threaded part are two diametrically-opposed lugs 12, each of which has a ramp-like surface 13.

The cap is attached to the container by screwing it on in the normal fashion, and as the cap is screwed on the fins 7 ride up the surfaces 13 of the lugs 12 and "snap" back behind the lugs. Any attempt to unscrew the cap from the container merely brings the fins 7 into contact with the stop surfaces 14 of the lugs 12.

However, if inwardly-directed radial pressure is now applied to the flat surface 6 of the band 5, the band will be deformed into elliptical or oval shape, the diameter of the band at the position of the fins 7 being increased to such an extent that the fins 7 will be moved clear of the stop surfaces 14. Continued counter-clockwise rotation of the cap is then permitted, and the cap can be unscrewed in the normal manner.

The bridges 4 are suitably positioned such that they are not substantially deformed during the deforming of band 5. This is achieved by arranging for the bridges 4 to join the band 5 at those positions where the ellipse formed by deforming the band 5 intersects the undeformed band.

Figure 2:
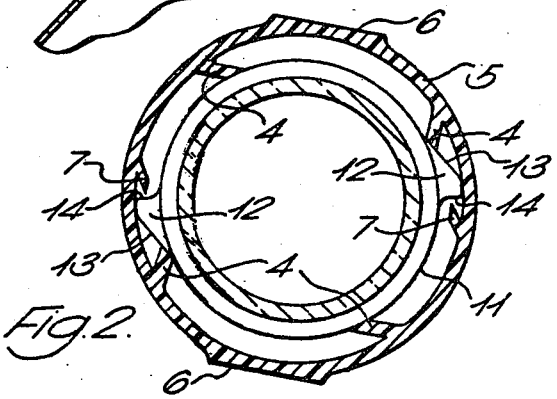
FIG. 2 is a section on the line A—A of FIG. 1.

By including the bridges 4, i.e. by forming them at an angle to the radius of the band 5 as shown in FIG. 2 for example, the torque transmission between the band 5 and the skirt 2 is improved.

Figure 3:
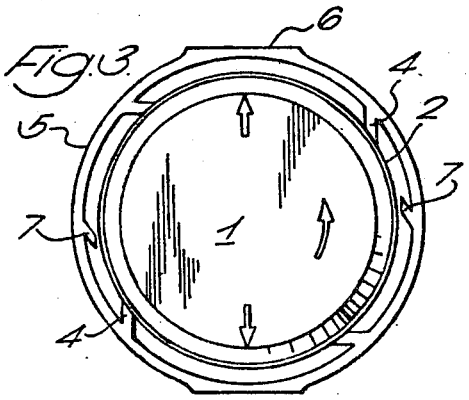
FIG. 3 is a plan view of the cap.
Figure 4:
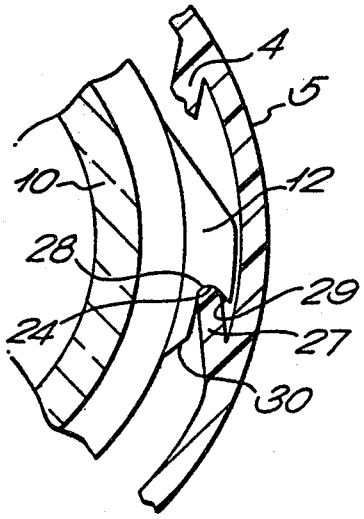
FIG. 4 is a detail, on an enlarged scale, of part of a second form of cap/container combination, having modified lugs and fins.

FIG. 4 shows a modified fin/lug arrangement, wherein the fins and lugs are shaped somewhat differently from those of FIGS. 1 to 3, the construction otherwise being identical to that of FIGS. 1 to 3. In the FIG. 4 embodiment, the fins 27 on the band 5 are formed not with "sharp" leading edges but instead with radiussed or rounded edges 28. At the same time the lugs 12 on the container are formed with concave engaging faces 24 so as to receive snugly the edges 28 of fins 27.

The face 24 of lug 12 is provided with an angled leading edge 29 to encourage the fin 27 to slide in to the recess formed by the shape of the face 24, and a small secondary ramp 30 is provided to limit the degree of bending stress experienced by the fin.

It will be appreciated that the present invention provides a safety closure of the "squeeze-and-turn" type whose shape is not determined (as are the shapes of prior art closures) by the necessity to deform the whole skirt wall in order to remove the closure from a container. Only the annular band 5 need be deformed in the present instance, so that less finger pressure is necessary for this than in prior art closures but yet at the same time the incidence of pressure being applied accidentally is less than in prior art closures, since it is more likely that a user will grasp the skirt 2 of the closure than the band 5.

A further advantage of the closure of the present invention is that shallower caps may be used than hitherto. In prior art "squeeze-and-turn" closures the skirts had necessarily to be relatively long to give the required flexibility; with the closure of the invention, wherein the skirt wall is not deformed, the skirt wall 2 need extend only to just below the thread on the container. This represents a substantial saving in material and hence in overall cost.

I claim:

1. A container and a closure cap therefor, wherein the neck of the container is screw-threaded and is provided with at least one lug beneath the screw thread, the closure cap comprising a top, a screw-threaded depending skirt and an annular band attached to the skirt by four spaced bridges, the annular band being provided with one or more fins adapted to engage the lug(s) on the container neck, the annular band being deformable by radial pressure at positions spaced from the fin(s) to increase the diameter of the band in the region of the fin(s) such that the fin(s) do not engage the lug(s) on the container neck, the bridges attaching the annular band to the skirt being so situated that they are substantially undeformed when the annular band is deformed.

2. A combination as claimed in claim 1 wherein the closure cap is provided with two diametrically opposed fins and the container is provided with two diametrically opposed lugs.

3. A combination as claimed in any of claim 1 or 2 wherein the fins are provided with rounded leading edges and the lugs with concave receiving surfaces.

4. A combination as claimed in claim 1 or 2 wherein the bridges joining the annular band to the skirt are inclined with respect to a radius of the cap.

5. A combination as claimed in claim 3, wherein the bridges joining the annular band to the skirt are inclined with respect to the radius of the cap.

* * * * *